United States Patent [19]

Ekstrom et al.

[11] B 3,993,912

[45] Nov. 23, 1976

[54] MARINE PROPULSION SYSTEM

[75] Inventors: Thomas E. Ekstrom; Richard L. Koch, both of Scotia, N.Y.

[73] Assignee: General Electric Company, Schenectady, N.Y.

[22] Filed: June 10, 1974

[21] Appl. No.: 477,597

[44] Published under the second Trial Voluntary Protest Program on February 17, 1976 as document No. B 477,597.

[52] U.S. Cl. ..... 290/17; 318/148

[51] Int. Cl.[2] ..... B60L 11/02

[58] Field of Search ..... 290/14, 17; 318/148

[56] References Cited

UNITED STATES PATENTS

| | | | |
|---|---|---|---|
| 2,321,302 | 6/1943 | Liwschitz | 318/148 |
| 2,451,936 | 10/1948 | Frisch | 318/148 |
| 2,454,778 | 10/1948 | Curry | 318/148 |

*Primary Examiner*—Robert K. Schaefer
*Assistant Examiner*—John W. Redman
*Attorney, Agent, or Firm*—Erwin F. Berrier, Jr.

[57] ABSTRACT

A marine propulsion system includes a gas turbine, a generator, a motor and a fixed pitch propeller. Means are provided to operate the motor synchronously in the normal ahead and astern directions and to operate the motor asynchronously in the slow ahead and astern directions with the gas turbine operating at its idle setting. Means are also provided to brake the propeller before astern torque is applied when the power propulsion lever is rapidly moved from the normal ahead setting to the normal astern setting by operating the motor as a generator.

1 Claim, 4 Drawing Figures

MARINE PROPULSION SYSTEM

This invention relates to a variable speed propeller drive system for marine propulsion and more particularly to a marine propulsion system which is adapted to provide a wide speed range while using a gas turbine engine as the prime mover and a fixed pitch propeller.

BACKGROUND OF THE INVENTION

In marine propulsion systems it is generally desirable to provide a propeller thrust range of about 25-to-1 as well as provisions for reversing. For this reason, when a single gas turbine is employed as the prime mover in a ship propulsion system, it has been the practice to use a controllable and reversible pitch propeller. While such an arrangement provides the desired control and reversing, controllable and reversible pitch propellers are expensive and are not readily accessible if maintenance is required.

The primary object of the present invention, then, is to provide a marine propulsion system which utilizes a gas turbine engine and a fixed pitch propeller and yet provides a wide range of propeller speed and thrust control and provisions for reversing.

SUMMARY OF THE INVENTION

Briefly stated, the present invention uses a three phase, AC generator which is electrically connected through switchgear to a synchronous motor which, in turn, drives a fixed pitch marine propeller over a wide speed range. The AC generator is driven by a gas turbine engine which is connected to the generator through a suitable gear box. In the normal ahead mode of operation, the motor is operated synchronously, at unity power factor, and thus follows the speed of the generator and the gas turbine. The normal astern mode of operation is achieved by reversing the electrical phase connection between the generator and the motor by means of the switch gear. When it is desired to operate the propeller at a speed below that which can be achieved when operating the motor synchronously, the excitation to the motor field winding is removed and the motor is operated as an induction motor, so that its output torque will be controlled by the voltage and frequency output of the AC generator. In this mode of operation, generator output voltage is controlled by varying its field exciter current and the gas turbine engine is operated at its minimum fuel setting.

When the propulsion system is required to move rapidly from the normal ahead mode to the normal astern mode the propeller speed is first reduced by reversing the electrical phase connection between the motor and the generator and by removing the generator field excitation and applying field excitation to the motor. In this manner, the motor is operated as a generator and the energy is dissipated in the system wiring and by plugging the generator. Additional energy dissipation can be achieved by including a dynamic braking resistor. When the propeller speed is reduced sufficiently, the motor is operated asynchronously in the astern direction until it reaches a speed sufficient for synchronous operation in the astern direction of rotation.

Hence, the present invention provides a gas turbine engine which is connected to an AC generator and is operable between a maximum and minimum power range in response to the setting of the propulsion power lever. The generator is electrically connected to a synchronous motor through switchgear means which are operative to reverse the electrical phase connections between the generator and motor and to switch in a dynamic braking resistor in response to the position setting of the propulsion power lever.

Means are provided to control the motor field excitation to achieve a unity power factor during synchronous operation of the motor. Means are also provided to apply a motor field exciter current when the motor is being operated as a generator in the rapid ahead-to-astern mode so as to regulate the output voltage.

Means are provided to regulate the generator field excitation so that the output volts per hertz of the generator is constant during operation in the normal ahead or normal astern modes. In addition, means are provided to control the generator field excitation in the slow ahead or slow astern modes as a function of propulsion power lever setting and propeller speed.

Mode selector means consisting of a logic network are provided to control the switchgear and to determine whether field excitation is required for the generator or motor and to determine which field excitation control means should be employed.

BRIEF DESCRIPTION OF THE DRAWINGS

The present invention as well as the objects and advantages thereof will become apparent upon reading the following description of the preferred embodiment in conjunction with the drawings, wherein.

DETAILED DESCRIPTION OF THE INVENTION

Figure 1:
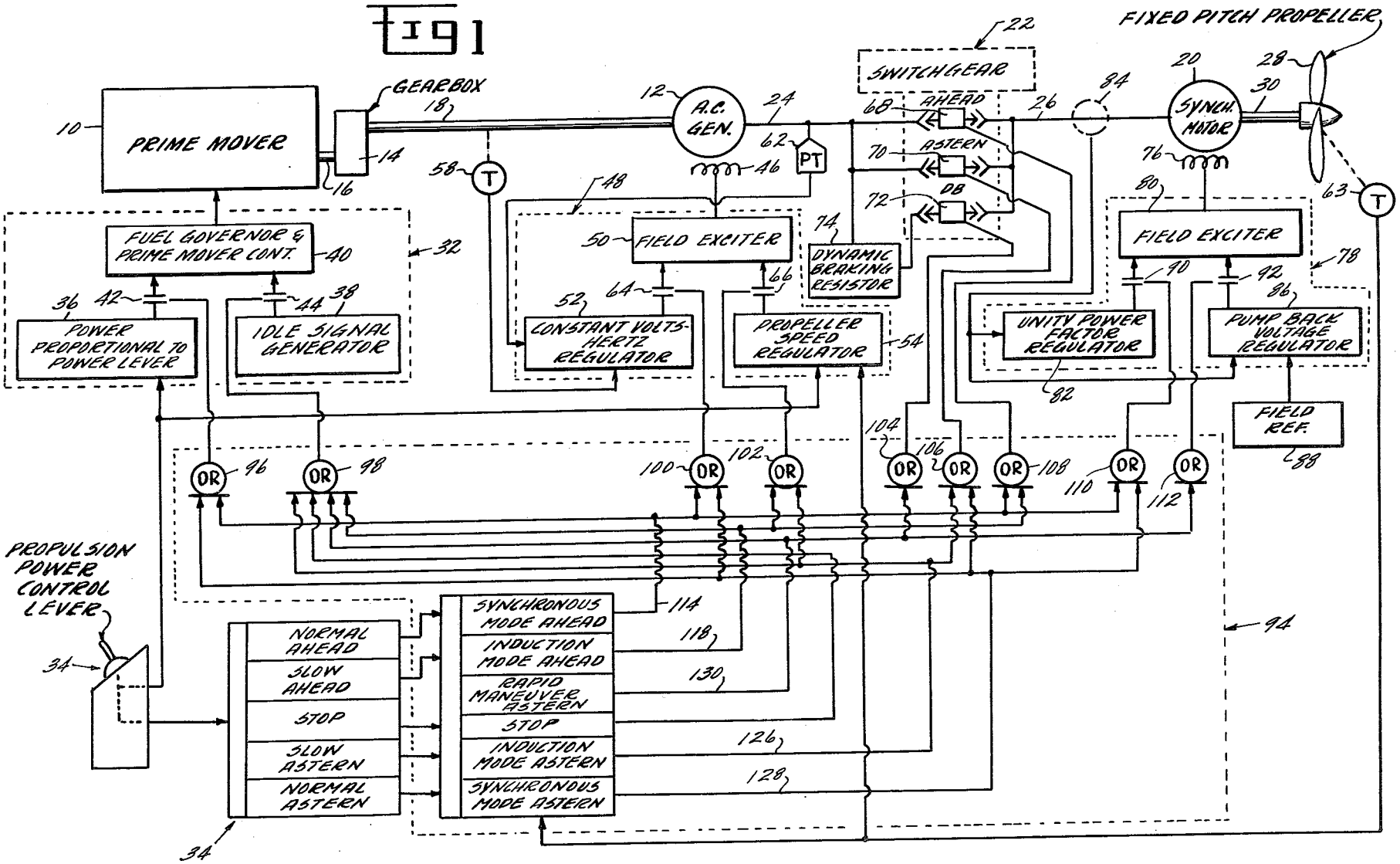
FIG. 1 is a schematic block diagram showing the marine propulsion system of this invention.

With reference to FIG. 1, a prime mover, such as a gas turbine engine, is shown at 10 and is connected to a three phase AC generator 12 through a suitable gearbox 14 and shafts 16 and 18. The AC generator 12, is electrically connected to a synchronous motor 20 through switchgear means 22 and power cables 24 and 26. The motor 20 is connected to a fixed pitch marine propeller 28 through a shaft 30.

The gas turbine 10 is preferably of the two shaft type wherein a high pressure turbine is connected to a compressor and a separate, low pressure or load turbine is connected to the gearbox 14. The gas turbine 10 includes suitable control means, shown generally at 32, for controlling the fuel flow to the gas turbine 10 as a function of a manually operated propulsion power control lever 34. A number of control systems which are well known to those skilled in the art may be effectively employed as the control means 32. One such control system, together with a two shaft gas turbine engine as described above, is shown in U.S. Pat. No. 3,638,422, issued Feb. 1, 1972, and assigned to the assignee of this invention.

With continued reference to FIG. 1, the engine control means 32 is shown as including means 36 for generating a control signal which is proportional to the setting of the propulsion power control lever 34, means 38 for generating a signal which calls for fuel flow to the turbine corresponding to an idel setting, and means 40 for receiving the output signal from means 36 and 38 through switches 42 and 44, respectively, and delivery of fuel to the combustor of gas turbine 10 in response to system demands. With reference again to U.S. Pat. No. 3,638,422, the control system shown in FIG. 2 of that patent could be effectively employed with only slight modification as has been provided for several mechanical drive ship propulsion machineries. In particular, the propulsion power control lever 34 of FIG. 1 of the present invention would be substituted for the adjustable voltage source 60 of FIG. 2 of the above referenced U.S. Patent and (with continued reference to FIG. 2 of the above referenced U.S. Patent) the output of amplifier 59 would be disconnected from amplifier 57.

With reference again to FIG. 1 of the present invention, the AC generator 12 includes field windings 46 and field exciter means 48. The field exciter means 48 has been shown as including means 50 for establishing the current in field windings 46 in response to an input signal from either regulator means 52 or regulator means 54. Regulator means 52 are of the well known type designed to adjust the current in field windings 46 so as to maintain the output of the generator 12 at a constant volts per hertz in response to an input signal on line 56 representative of the speed of shaft 18 which is generated by a suitable speed sensor 58 and an input signal on line 60 representative of the voltage output of generator 12 which is provided by a suitable voltage sensor 62.

The regulator means 54 is of the type adapted to vary the current in field windings 46 so as to maintain propeller speed at the desired level when motor 20 is operating asynchronously in response to the position of propulsion power control lever 34 and a signal representative of the speed of propeller 28 which is generated by a suitable speed sensor 63.

As shown in FIG. 1, the regulator means 52 and 54 are connected to field exciter means 50 by suitable switches 64 and 66, respectively.

The switchgear means 22 has been shown as including an ahead switch 68, an astern switch 70 which reverses the electrical phase connection from that of the ahead switch, and a dynamic break switch 72 which reverses the electrical phase connection in the same manner as the astern switch and also switches a dynamic braking resistor 74 into the circuit.

The motor 20 includes field windings 76 and means 78 for establishing the excitation level or current therein. The field excitation means 78 includes an exciter 80 and a unity power factor regulator 82 of the well known type that will cause the field exciter 80 to adjust the exciter current so as to maintain a unity power factor based on an input signal of voltage and current from a suitable power factor sensor 84. The field excitation means 78 also includes a pump back voltage regulator 86 for receiving a fixed reference signal from signal generator 88 and a voltage level signal from sensor 84 so as to vary the field excitation and maintain a constant voltage output from motor 20 when the motor is being operated as a generator. Regulators 82 and 86 are connected to the field exciter 80 through switches 90 and 92 respectively.

Mode selector means 94, which consists of a suitable logic network, is provided for control and sequencing of the switchgear means 22 and the other switches previously described when the power propulsion lever is moved through its various positions. Mode selector means 94 includes a suitable "or" logic for control of each switch. Logic 96 is associated with switch 42, 98 is associated with switch 44, 100 is associated with switch 64, 102 is associated with switch 66, 104 is associated with the dynamic brake switch 72, 106 is associated with the astern switch 70, 108 is associated with the ahead switch 68, 110 is associated with the switch 90, and logic 112 is associated with the switch 92. As will be understood, if there is a signal input on either of the input lines to any of the logic means, the switch associated therewith will close.

In operation, when the propulsion power control lever 34 is in the normal ahead position or mode, a signal is established on line 114 closing switches 42, 64, 68 and 90. In this mode, the gas turbine speed and, hence, the generator speed and frequency, is determined by the setting of the lever 34 within the normal ahead range. The generator output volts per hertz is maintained constant by the regulator means 52 and field exciter 50 and the synchronous motor is operated at unity power factor by regulator means 82 and exciter 80 so that the motor speed and, hence, the propeller speed follows the gas turbine speed. It will be understood that when the motor 20 is coming up to synchronous speed it is operated without excitation to the field winding 76 by the field exciter 80 and regulator means 82, and that when the motor is close to synchronous speed, the field exciter 80 and regulator means 82 provide excitation to the windings 76 and lock the motor into synchronous operation with the generator 12 and, hence, with the output speed of the gas turbine 10.

Figure 2:
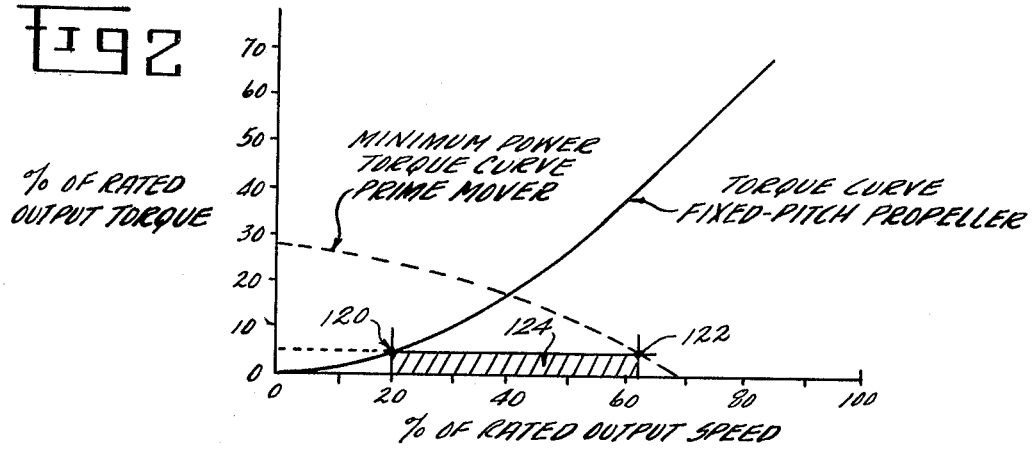
FIG. 2 shows exemplary torque-speed curves for a gas turbine and a fixed pitch marine propeller.

With reference now to FIG. 2, an exemplary torque-speed curve for a fixed pitch propeller is shown along with an exemplary torque-speed curve for a gas turbine engine while operating at idle or minimum allowable fuel flow. The intersection 116 of these two curves (at approximately 40 percent of rated output speed) is the minimum propeller speed that can be achieved in the normal ahead mode of operation or when operating the motor 20 synchronously. It will be understood, of course, that the curves of FIG. 2 are exemplary only and would vary depending on the gas turbine and fixed pitch propeller selected.

Figure 3:
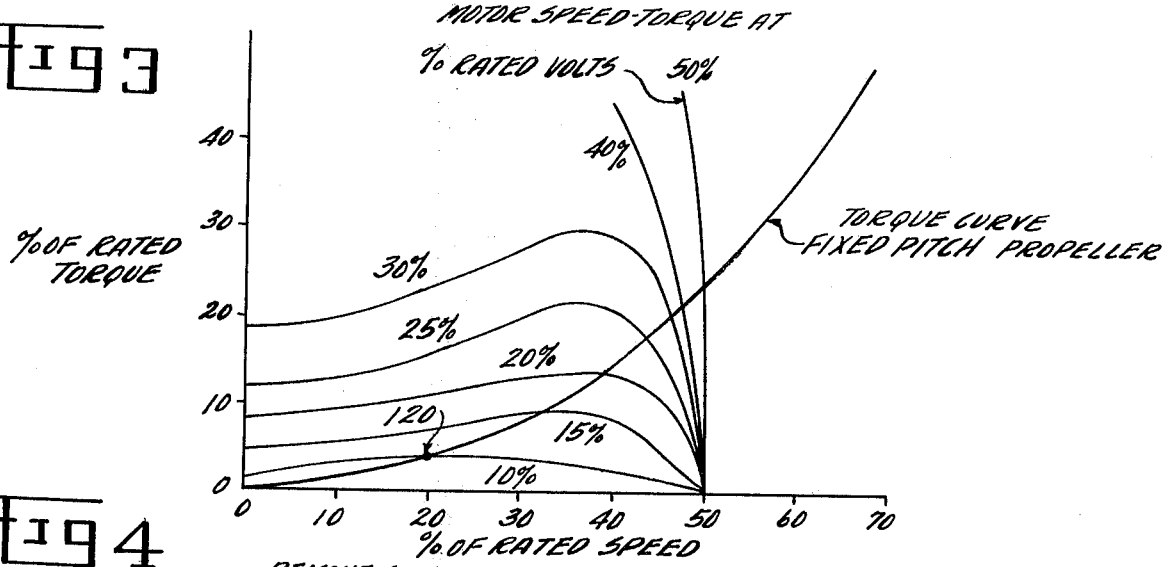
FIG. 3 shows an exemplary torque-speed curve for a fixed pitch marine propeller and an exemplary family of motor torque-speed curves at a reduced generator speed.

When operating the propeller at speeds below the intersection point 116, such as in the slow ahead power lever setting, the signal on line 114 is removed and a signal is established on line 118 which causes switches 42, 64 and 90 to open and switches 44 and 66 to close. In this mode the gas turbine is operated at an idle setting as established by means 38, the field excitation is removed from motor 20 and the generator field excitation is controlled by regulator 54 so as to vary the output voltage of generator 12. As will be apparent from FIG. 3, which illustrates this mode of operation, as the voltage applied to the motor is reduced, the intersection of the motor speed-torque curve and the propeller speed-torque curve moves in a reduced speed direction. It will be seen from the FIG. 3 example that when generator voltage output is reduced to 10 percent of the rated motor voltage, the motor torque-speed curve intersects the propeller torque-speed curve at point 120 producing a propeller speed of approximately 20 percent of rated. At the same time, from FIG. 2 it will be apparent that when the propeller is operating at point 120 of FIG. 2, the gas turbine will be operating at point 122, or at about 62 percent of rated speed, with the slip loss energy due to the asynchronous operation of motor 20 being indicated by the cross-hatched area 124 of FIG. 2.

Operation in either the slow astern or normal astern power lever settings is the same as that described above for the ahead counterparts, except that a signal is established on line 126 or 128, and the signal on either line 114 or 118 is removed, causing the ahead switch 68 to open and the astern switch 70 to close and, thereby, reverse the electrical phase connection and, hence, the direction of rotation of the motor.

As previously mentioned, when the propulsion lever 34 is moved rapidly from the normal ahead range to the normal astern range, the propeller 28 must be slowed down before the direction of motor torque can be reversed. With reference to FIG. 1, when the lever 34 is so moved, the signal on line 114 is removed, opening switches 42, 64, 68, and 90, and a signal is established on line 130 closing switches 44, 72 and 92. In this mode of operation, the gas turbine 10 is operated at an idle setting by controls 38, 40, field excitation is removed from the generator field windings 46, the electrical phase connection between the generator 12 and motor 20 is reversed, and dynamic braking resistor 74 is switched into the circuit. In this mode of operation the excitation to motor field windings 76 is controlled by regulator 86 and exciter 80 so as to regulate the output voltage from the motor 20. As will be appreciated, in this mode of operation, the foreward motion of the ship will cause the propeller 28 to continue rotating in the ahead direction. Such motion is, however, resisted by operating the motor 20 as a generator and dissipating the energy generated by the system wiring, by plugging the generator 12, and by the braking resistor 74.

When the propeller speed has been slowed sufficiently to permit the motor 12 to drive the propeller in the astern direction, the signal is removed from line 130 and a signal is established on line 126 so that the system operates for a short time in the slow astern mode previously described until the motor speed approaches synchronous speed. At this point, the signal on line 126 is removed and a signal is established on line 128 and normal astern synchronous operation is achieved.

Figure 4:
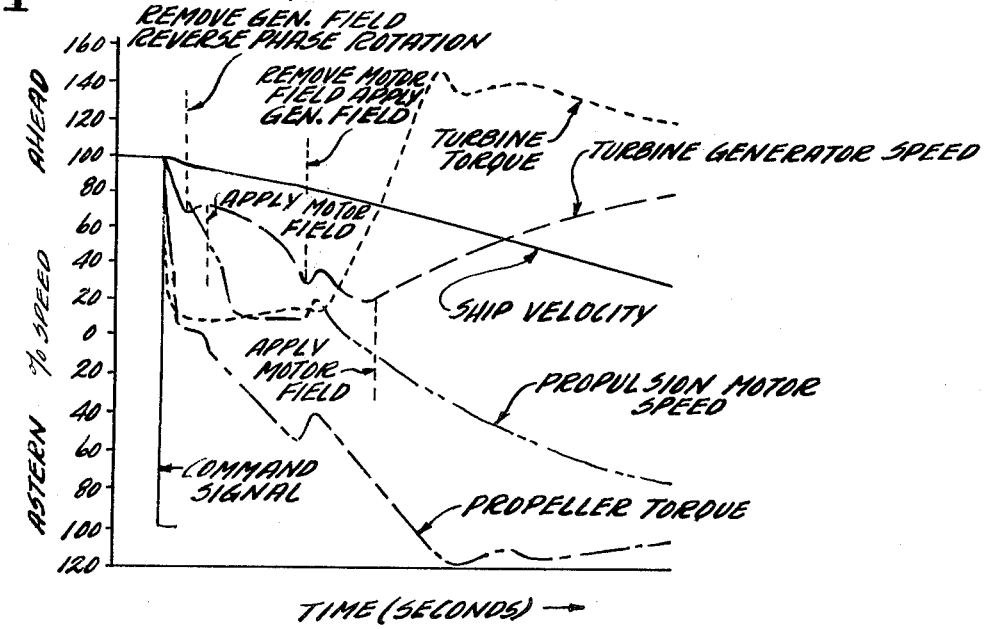
FIG. 4 is a graph showing the time change in gas turbine torque, turbine generator speed, motor speed and propeller torque, when the marine propulsion system of this invention is moved from full ahead to full astern.

The above described time sequencing when the power lever 34 is moved from normal ahead to normal astern is depicted graphically in FIG. 4, starting at the time the power lever is manually moved.

From the foregoing, it will be appreciated that the present invention provides a marine propulsion system which utilizes a fixed pitch propeller and a gas turbine engine as the prime mover and yet provides for reversing and a wide range of propeller speed and thrust control.

While the propulsion system of this invention is particularly useful when using a gas turbine as the prime mover, it will be appreciated that the present invention is not limited thereto, and that it may be beneficially employed using other prime movers of limited speed or power range.

What is claimed is:

1. A marine propulsion system comprising:

a power propulsion lever manually movable between and within a normal ahead range, a slow ahead range, a slow astern range, and a normal astern range;

a gas turbine engine including means for controlling the output thereof between an idle setting and a maximum power setting response to the position of said power propulsion lever, said gas turbine being in said idle setting when said lever is positioned in said slow ahead and slow astern ranges;

an AC generator, said generator connected to and driven by said gas turbine and including a field winding;

a synchronous motor electrically connected to the output of said generator and including a field winding;

a fixed pitch marine propeller connected to an output shaft of said motor;

a braking resistor;

switchgear means for selectively providing a first, second and third electrical connection between said generator and said motor, said first electrical connection causing said motor to produce torque in an ahead direction, said second electrical connection reversing the phase connection from that of said first electrical connection, said third electrical connection reversing the phase connection from that of said first electrical connection and connecting said braking resistor in series between said generator and said motor; and means for controlling the excitation current in said generator field winding, the excitation current in said motor field windings and said switchgear means in response to the setting of said power control lever and selected parameters of propulsion system operation whereby when said lever is in said normal ahead and astern range said motor is operated synchronously, when said lever is in said slow ahead and astern range said motor is operated in a controlled manner asynchronously, and when said lever is rapidly moved from the normal ahead range to the normal astern range said switchgear means assumes said third connection and the field current is removed from said generator winding and applied to said motor winding so as to brake said propeller before torque is applied in the astern direction by operating said motor as a generator and absorbing the generated energy using the wiring of the propulsion system and said generator.

* * * * *

UNITED STATES PATENT OFFICE

CERTIFICATE OF CORRECTION

PATENT NO. : 3,993,912

DATED : November 23, 1976

INVENTOR(S) : Thomas E. Ekstrom/Richard L. Koch

It is certified that error appears in the above-identified patent and that said Letters Patent are hereby corrected as shown below:

In column 6, claim 1, line 17, insert the word "in" between the words "setting" and "response".

Signed and Sealed this

First Day of February 1977

[SEAL]

*Attest:*

RUTH C. MASON
*Attesting Officer*

C. MARSHALL DANN
*Commissioner of Patents and Trademarks*